US006604729B2

(12) United States Patent
Fagan

(10) Patent No.: US 6,604,729 B2
(45) Date of Patent: Aug. 12, 2003

(54) NAIL EXTRACTOR APPARATUS

(76) Inventor: Chris R. Fagan, 1711 E. Bakerview, Bellingham, WA (US) 98226

( * ) Notice: Subject to any disclaimer, the term of this patent is extended or adjusted under 35 U.S.C. 154(b) by 0 days.

(21) Appl. No.: 09/745,364

(22) Filed: Feb. 27, 2001

(65) Prior Publication Data

US 2001/0025949 A1 Oct. 4, 2001

Related U.S. Application Data

(60) Provisional application No. 60/172,862, filed on Dec. 20, 1999.

(51) Int. Cl.[7] ..... B66F 15/00
(52) U.S. Cl. ..... 254/26 R
(58) Field of Search ..... 254/25, 26 R; 81/20

(56) References Cited

U.S. PATENT DOCUMENTS

| | | | | |
|---|---|---|---|---|
| 450,922 A | | 4/1891 | Truman | |
| 463,817 A | | 11/1891 | Slocom | |
| 587,155 A | | 7/1897 | Minnemeyer | |
| 977,986 A | | 12/1910 | Waddell | |
| 1,093,946 A | | 4/1914 | Platt | |
| 1,101,105 A | | 6/1914 | Thorne | |
| 1,915,892 A | * | 6/1933 | Keizer | 254/25 |
| 2,300,840 A | | 4/1940 | Huxel | |
| 2,906,498 A | | 11/1955 | Erwin | |
| 3,134,574 A | | 1/1962 | Reuterfors | |
| 4,762,303 A | | 8/1988 | Thomas | |

* cited by examiner

*Primary Examiner*—Robert C. Watson
(74) *Attorney, Agent, or Firm*—Robert B. Hughes; Hughes Law Firm, PLLC

(57) ABSTRACT

A nail extraction tool comprising a head portion and a shaft portion where the head portion has a contact surface that is adapted to engage a wooden surface to extracting nail without leaving an indentation upon the wood surface. The nail extraction tool further is adapted to hang from the loop of the belt where the shaft portion extends therethrough the loop and the tool is supported by the lower surface of the head portion.

6 Claims, 5 Drawing Sheets

NAIL EXTRACTOR APPARATUS

RELATED APPLICATIONS

This application claims priority of U.S. Provisional Application Ser. No. 60/172,862, which was filed Dec. 20, 1999.

FIELD OF THE INVENTION

The invention relates to nail pulling devices. Specifically, hand held nail pulling devices for finish work. The present invention relates to portable compact nail pulling devices.

BACKGROUND ART

A search of the patent literature has a number of patents directed toward these problems, these being the following:

U.S. Pat. No. 4,762,303 Thomas, shows a prying tool that is provided with a handling loop 68. U.S. Pat. No. 3,134,574 Reuterfors, shows a bar with a cup like configuration at the prying end. U.S. Pat. No. 2,906,498 Erwin, shows a tool in which one end is provided with a flat prying edge 36, and a "T", type head 12.

U.S. Pat. No. 2,300,840 Huxel, shows a pry bar which resembles the prior art shown in FIG. 1. U.S. Pat. No. 1,101,105 Thorne, shows a "T", shaped handle on a tack puller. The claw is inverted as compared to other bars. Although the handle 45 is "T" shaped there is no disclosure that this configuration facilitates a hanging the item from a loop. U.S. Pat. No. 1,093,946 Platt, shows a nail puller, pry bar with an "T", like handle 11.

U.S. Pat. No. 977,986 Waddell, shows a claw at one end of a bar with a crossed element at the other. The claws 1 extend to opposite sides from each other. It does not appear that the upper surface in FIG. 1 maintains a constant curvature. U.S. Pat. No. 587,155 Minnemeyer, shows a hammer with a wire handle. At one end is the cross head, and the other a nail pulling claw. U.S. Pat. No. 463,817 Slocom, shows a hammer with head "B", and replaceable tack pulling element at the other end of the handle.

U.S. Pat. No. 450,922 Truman, provides a puller with a claw at one end of the handle and a crossing element at the other.

The prior art fails to show a nail pulling device with a head portion that comprises a nail pulling end and an impact end where both ends have had a surface that allows the tool to be conveniently hung from a loop.

SUMMARY OF THE INVENTION

The invention is a nail extraction tool having a center axis and a lengthwise axis. The nail extraction tool is adapted to be mounted to a loop when not in use, and is further adapted to extract a mail having a head and a shaft. The tool comprises a head portion that has a front portion and a rear portion. A contact surface extends from the front portion to the rear portion. The head portion comprises an extension located in the rear portion that has a first loop contact surface which is adapted to engage the loop. The head portion further comprises a hook portion positioned in the front portion and has a surface adapted to engage the head of the nail. The hook portion further has a second loop contact surface adapted to engage the loop. The tool further has a shaft portion having a center axis and also a forward surface and a rearward surface. The first loop contact surface has a lengthwise component that extends forwardly from the forward surface of the shaft portion and a second loop contact surface has a lengthwise component that extends outwardly from the rearward surface of the shaft portion. The shaft portion is adapted to extend through the loop where the tool is adapted to be supported by the loop.

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

The detailed description of first began with a will review of the general operation of the claw 20 to and then have a brief introduction to the prior art of the claw 20. Finally there will be an in depth discussion and description of the preferred embodiment of the present invention.

Figure 6:
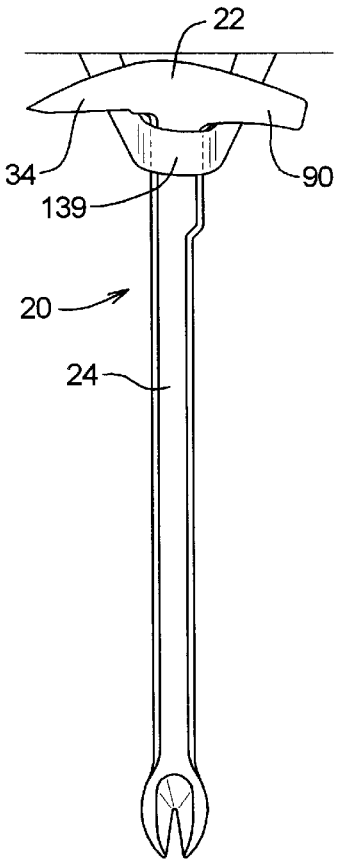
FIG. 6 is a side view of the apparatus of the present invention which is hung from a loop.

The tool 20 is used for extracting nails from a wood surface. The tool 20 is commonly attached to a carpenter's work belt by being hung in a loop portion. As seen in FIG. 6, the tool 20 can be easily hung from a strap where the fork and head portions of the tool 20 act as a support to hold the tool 20 therein. The tool 20 is generally light weight and easy to reach on the carpenter's tool belt. When the carpenter desires to use the tool 20 he can easily withdraw the tool from the loop on his work belt. When he is finished with the tool 20, he can easily reinsert the tool into the loop of his tool belt.

Figure 4:
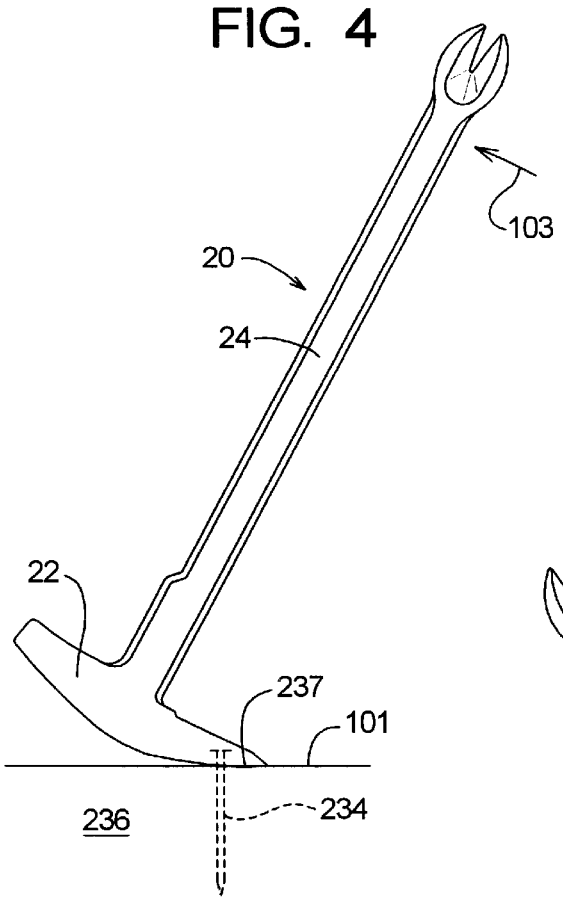
FIG. 4 is a side view of the apparatus of the present invention where is beginning to extract a nail.
Figure 5:
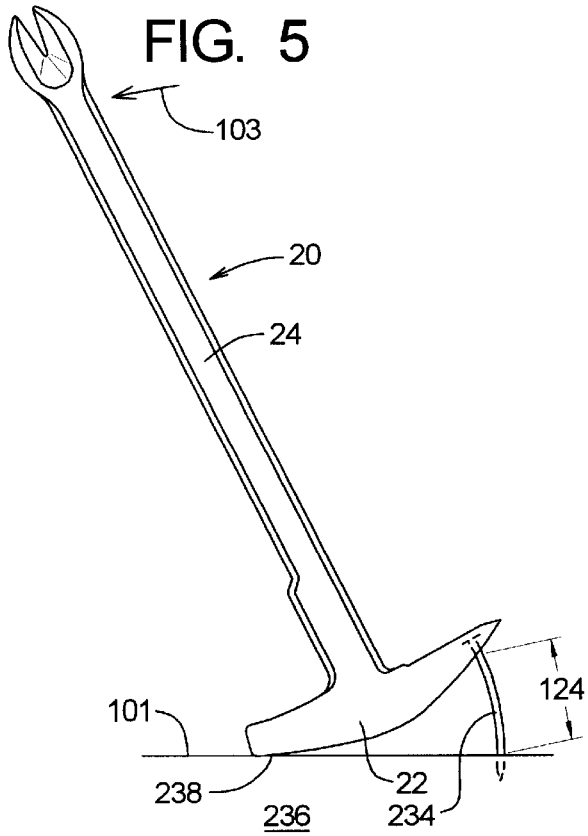
FIG. 5 is a side view of the apparatus of the present invention finishing the nail extraction process.

As seen in FIGS. 4 and 5, the claw 20 is designed to engage the head of a nail in the fork portion of the claw 20 and the head portion rolls on a surface to extract a nail. If necessary, the head portion of the tool can be struck with a hammer in order to engage the nail in the fork portion (this will be discussed in more detail below). A moment is applied to the tool which is generally a force upon the tool at a distance from the wood surface that is indicated at 103 in FIGS. 4 and 5 which rotates the head portion as it rolls about the rolling surface thereby increasing the distance from the fork portion and the wood surface.

Figure 1:
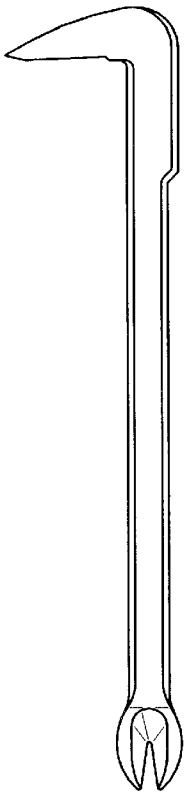
FIG. 1 PRIOR ART
FIG. 1 is a side view of a prior art device.

There will now be a brief description of the prior art and a comparison of the prior art to the present invention will resume after the detailed description of the present invention. As seen in FIG. 1, the prior art comprises a shaft portion and a fork portion. However, a head portion is not present in the prior art. With reference to FIG. 6, it is not possible to hang the tool 20 by a strap where there is no head portion to provide support. Because the carpenter will move, twist and be in an assortment of positions and orientations the prior art tool is likely to fall out of the loop on his tool belt and potentially be lost in the mud or inflict serious damage on a co-worker below. Further, the head portion in the present invention allows a greater vertical separation from the fork portion and the wooden surface as shown in FIG. 5. The prior art in lacking the head portion will achieve less separation from the wood surface to the fork portion of the prior art tool when extracting a nail. The ramifications of the lack of a head portion of the prior art tool will be discussed further herein.

Figure 2:
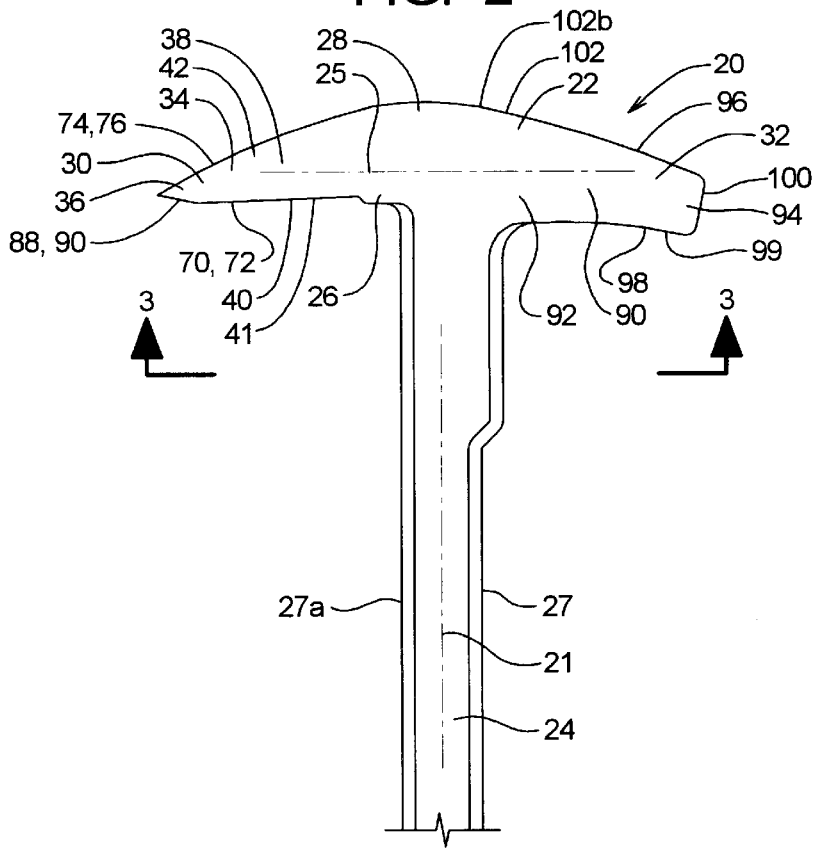
FIG. 2 is a side view of the head portion of an embodiment of the present invention.
Figure 3:
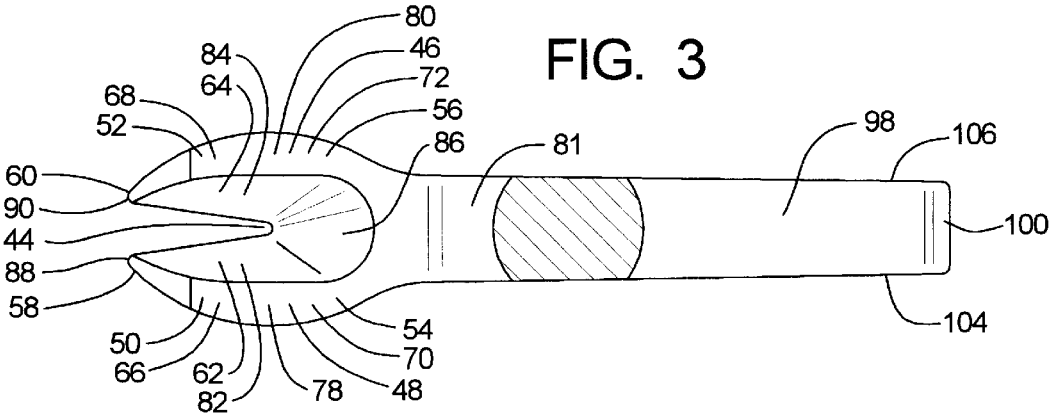
FIG. 3 is a cross-sectional view of the head portion taken at line 3—3 in FIG. 2.
Figure 3A:
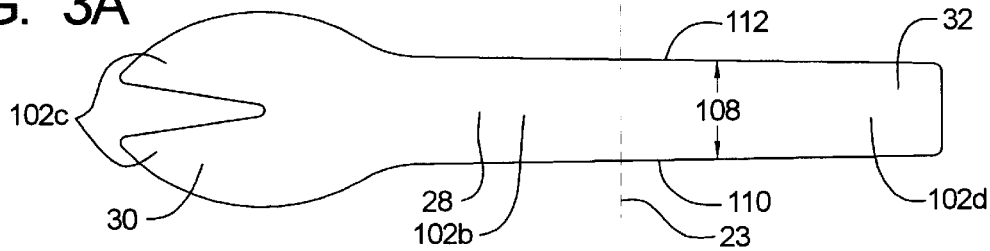
FIG. 3*a* is a top view of the head portion.

For purposes of description, the tool 20 shall be considered as having a longitudinal center axis 21, a transverse axis 23 and a lengthwise axis 25 (see FIGS. 2 and 3*a*).

There will now be a detailed description of the tool 20 and the various features and components thereof. The tool 20 comprises a shaft portion 24 and a head portion 22. The shaft portion 24 has a forward surface 23 and a rearward surface 27

The head portion 22 comprises a hook portion 34 and an extension portion 90 that will each be furthered described herein. In general, the head portion 22 has a lower portion 26 and an upper portion 28 a front portion 30 and a rear portion 32. Located in the front portion 30 is the hook portion 34 which comprises an end portion 36 and base portion 38 and lower portion 40 and upper portion 42. The lower portion 40 has a lower contact surface 41 adapted to engage the loop 139 as shown in FIG. 6. As seen in FIG. 3, the hook portion 34 further comprises an inner area 44 and a first lateral area 46 and a second lateral area 48. Located in each lateral area are forks 50 and 52. Each fork comprises a base portion 54 and 56 and end portion 58 and 60 and inner portion 62 and 64 and outer portion 66 and 68. Further, each fork 50 and 52 has a lower portion 70 and 72 and an upper portion 74 and 76. Located in the lower portion of each fork 50 and 52, are base surfaces 78 and 80 which are apart of front lower surface 79 which includes rear front lower surface 81 toward the inner portions 62 and 64 of fork members if the 52 is an oblique surfaces 82 and 84. At the base and portions 38 lies oblique surface 86. In the front-end portion 58 and 60 of the forks 50 and 52, lies a front surface 88 and 90 that are adapted to engage under the head of a nail as seen in FIGS. 4 and 5. The inner surface of the forks 50 and 52 is defined as an engagement surface or a nail head engagement surface.

On the other side of the head portion 22 in the rear portion 32, lies the extension portion 90, which comprises a base end portion 92, rear portion 94, an upper portion 96 and a lower portion 98. Located in the rear portion 94 is an impact surface 100. In the upper portion 96 lies a rolling surface 102*a* that will be discussed further herein. The extension 90 comprises a first side 104 and a second side 106. The lower portion has a lower contact surface 99 adapted to rest upon a strapped 139 as shown in FIG. 6. The lower contact surface 99 has a lengthwise component that extends beyond the rearward surface 27 of the shaft 24. Likewise, the lower surface 41 has a lengthwise component that extends beyond the forward surface 23.

The rolling surface 102 extends from the rear portion 32, to the upper portion 28 of the head 22 to the upper portions 74 and 76 of the forks 50 and 52. The rolling surface has an average width 108 that spans from a first edge 110 to a second edge 112. The width 108 and the overall length from the front portion 30 to the rear portion 32 results in the net surface area of the rolling surface 102.

Figure 7:
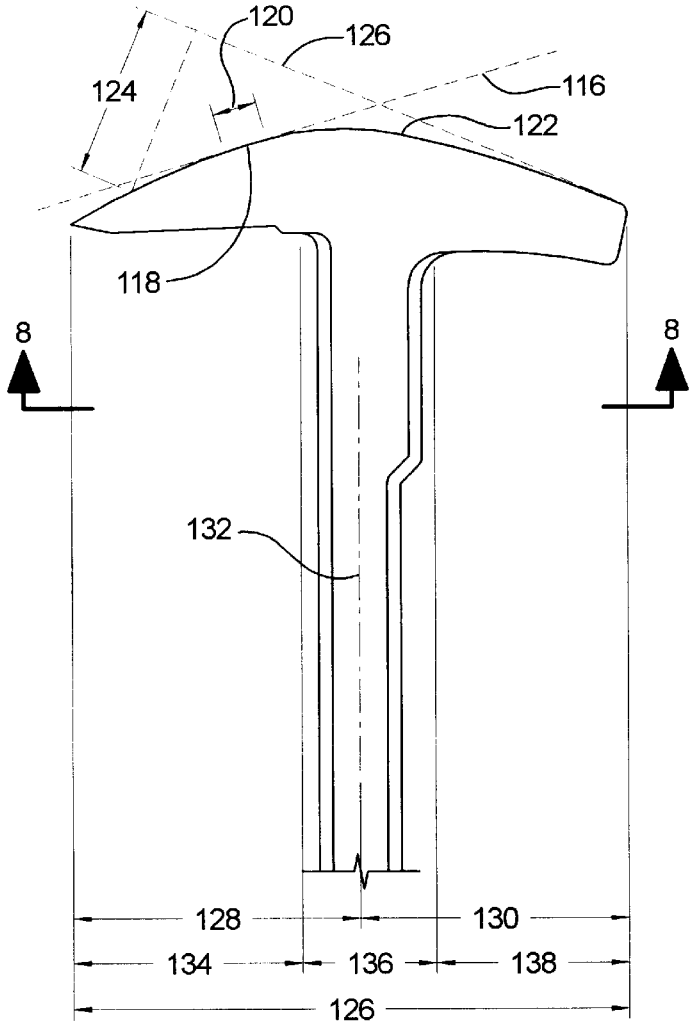
FIG. 7 is a side view of a second embodiment of the head portion at various angles with respects to a wood surface.
Figure 8:
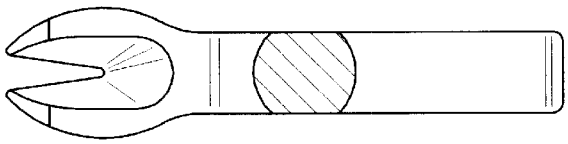
FIG. 8 is a cross-sectional view taken at line 8—8 in FIG. 7.

As shown in FIGS. 7 and 8, there is another embodiment of the invention with two subtle differences that have an impact on the effectiveness of the tool. When a carpenter is doing finishing work he must be careful not to make indentations in the wood surfaces. The indentations are a result of pressure that is a function of force and surface area (Pressure=(Force)/(Surface Area)). The force to extract a nail is a function of the coefficients of friction between the nail surface of the nail shaft and the internal surface of the wood, and further the force of the wood surrounding the nail shaft. It is not feasible to reduce the amount of force required to extract the nail. In order to decrease the pressure upon the wood surface in a nail extraction operation the surface area of the tool that is in contact with the wood surface must be altered. Therefore increasing the surface area of the rolling surface 102 will decrease the pressure applied to the wood surface and hence lower the chances of occurrence of accidental indentation of the wood surface. As seen in FIG. 8, the width 114 is slightly wider than the width 108 of FIG. 3*a*.

As seen in FIG. 7, plane 116 represents the plane of a wood surface that is in contact with the head portion 22. This plane 116 represents the orientation of the tool 20 with respects to the wood surface 101 at some point in the nail extraction process between FIG. 4 and FIG. 5. The average contact surface portion 118 is the amount of surface area that is in contact with the wood surface at any given moment during the duration of the extraction procedure. The average contact surface 118 is a function of the curvature of the rolling surface 102, the hardness of the wood and the width 114. By increasing the width 114 the average contact surface 118 is increased thereby reducing the pressure on a wooden surface.

Figure 9:
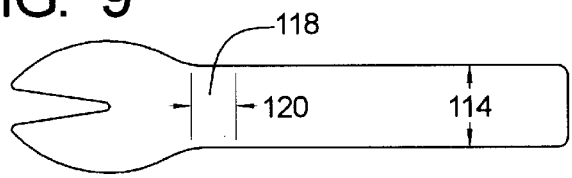
FIG. 9 is a top view of the head portion.

The second embodiment in FIGS. 7, 8 and 9 has an additional difference other than the first embodiment in FIGS. 2 and 3 and that is the curvature of rolling surface 122. As seen in FIG. 7 the curvature is about a 2.75 inch radius. Of course this is only the preferred form, the curvature could be 1.5" radius to 10" radius.

When the tool 20 is in the position shown in FIG. 5 the distance from the rolling surface 102*c* (or 120*c* for the second embodiment) is represented as distance 124. As seen in FIG. 5, distance 124 has to at least be sufficiently long enough to clear a nail. So for a common 3½" nail distance 124 should be 2¾–3 inches. Better seen in FIG. 7, the plane 126 represents the surface 101 in FIG. 5. The distance 124 is dependent upon 1) the curvature of the rolling surface 120 and 2) the effective length of the rolling surface 120 represented as distance 126. Therefor to increase the distance 124 the tool can either 1) decrease the radius of curvature of the rolling surface 120 and/or 2) increase the overall length of the head portion (increase distance 126). The problem with the first solution is that a tighter curvature of rolling surface 120 creates a smaller contact portion 118 (see FIG. 8*b*) which will result in a higher pressure on the surface 101. Therefor the second option of increasing distance 126 (the length of the head portion 22) is a more desirable. By having distance 126 two and a half to five inches, a sufficient distance 124 is a result.

The distance 126 is further divided into the sum of a front distance 128 and a rear distance 130. The front distance is defined from the foremost portion of surface 120 (or 102) in the lengthwise axis direction to a center axis 132 that is parallel to the longitudinal center axis 21. Rear distance 130 is defined as rearmost portion of surface 120 (or 102) in the lengthwise axis direction to the center axis 132.

The distance 126 can further be subdivided into three linear parallel distances, namely the front contact portion distance 134, shaft portion distance 136 and rear contact portion distance 138. The distance 134 is essentially the distance of exposed surface area in the lengthwise axis direction for the exposed surface area of the base surface.

As seen in FIG. 6, the tool 20 can by hung from the strap or loop 139 by inserting the shaft portion 24 through the loop. The hook portion 34 and the head portion 90 provides a blocking system so the tool 20 will not fall out of the loop 139. The loop 139 is connected to a carpenter's work belts or otherwise attached to the carpenter or a storage location.

Figure 10:
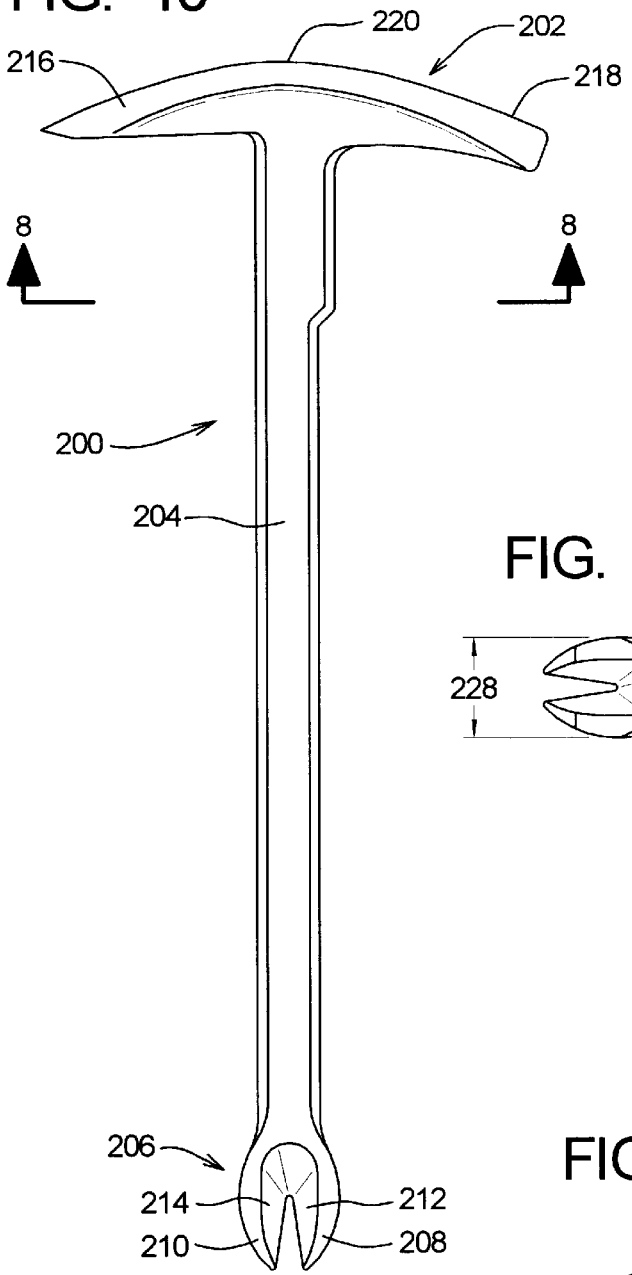
FIG. 10 is a side view of a third embodiment of the apparatus of the present invention.
Figure 11:
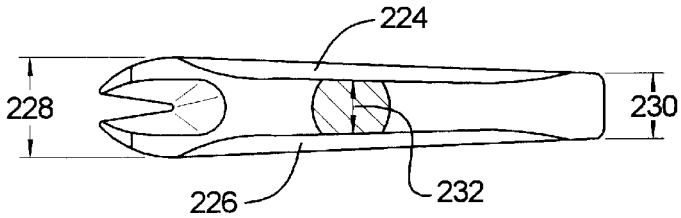
FIG. 11 is a cross-sectional view of the tool taken at line 11—11 of FIG. 10.
Figure 12:
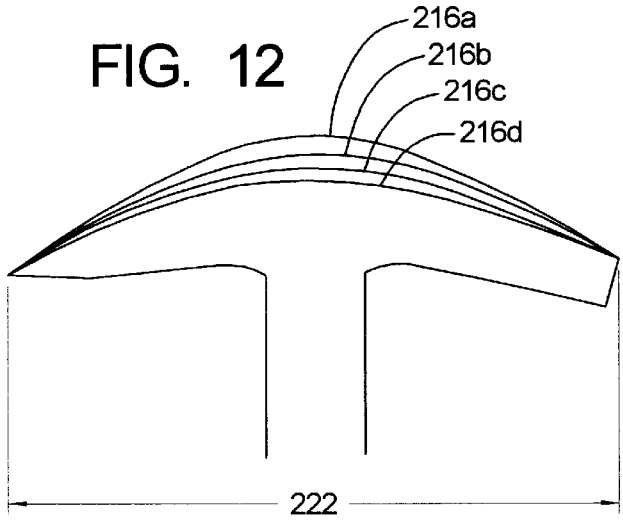
FIG. 12 is a side view of the head portion of the tool illustrating a number of contact surfaces that could be employed.

FIGS. 9 through 11 disclose a third embodiment of the present invention that is particularly advantageous for doing finish work and working with softer surfaces. The tool 200 comprises a head portion 202 and a shaft portion 204. As in the prior embodiments, the lower portion of the shaft 202 has a second nail extraction portion 206 to that comprise fork members 208 and 210. The fork members 208 and 210 have an inner oblique surface 212 which is adapted to engage the head of the nail that is embedded in wood. On the backside of the shaft 204 is a rolling surface 214 which is adapted to engage a wood surface and extracting the nail. During the nail extraction process using the second nail extraction portion, the head portion 202 functions as a handle for the worker who can wrap his fingers around the head portion and the fork portion. The length of the shaft 204 will determine the amount of leverage that can be exerted on a nail in the fork portion 206.

There will now be a discussion of the modifications of the third embodiment which primarily deal with the head portion 202. The head portion 202 comprises a hook portion 216 and an extension portion 218. The upper area of the hook portion 216 and the upper area of the extension portion 218 define a contact surface 220 which is substantially similar to contact surface 102. As seen in FIG. 11, there is shown a variety of contact surfaces 216*a* through 216*d*. At one extreme, 216*a* is particularly advantageous when dealing with longer nails which require a greater distance 124 as seen in FIG. 7. Further, distance 222 is greater which creates a longer tangential distance of surface 216. On the other extreme, surface 216*d* has a greater radius of curvature and is particularly advantageous when extracting nails of shorter length and an environment with very soft woods. As mentioned previously, a greater radius of curvature allow for a greater average contact portion 120 as seen in FIG. 9.

As seen in FIG. 10, the head portion 202 comprises a first flange 224 and a second flange 226 the forward portion of the head 202 the lateral width between the edges of the flanges 224 and 226 is designated as 228. And at the rear portion of the head 202 the lateral width between the edges of the flange is 224 and 226 is designated as 230. Further, the average width of the shaft portion 204 is designated as 232. It can be seen in FIG. 10 that the flange is 224 and 226 extend laterally beyond the average width 232 and shaft portion 204 so as to provide a greater surface area so less pressure is exerted on a wood surface. By extending these flange is laterally the tool weighs less than if the shaft portion 204 was a similar width.

It should be noted that the preferred form, the lateral width distance 228 is slightly greater then the lateral width distance 230. The advantages of this configuration can be most easily described with reference to FIGS. 4 and 5. As seen in FIG. 4,the nail to 34 is almost fully embedded into the wood surface 236. In this position the greatest amount of force upon the nailhead is required to begin extracting it. To accommodate this force, a greater contact surface 236 will cause a lower pressure to be exerted on the wood surface. As seen in FIG. 5, the nail 234 is almost really extracted from the wood material 236 and requires very little force upon the nailhead to fully withdraw the nail 234. Therefor the average contact surfaces 238 can be less by decreasing the width 230 as seen in FIG. 10.

Figure 13:
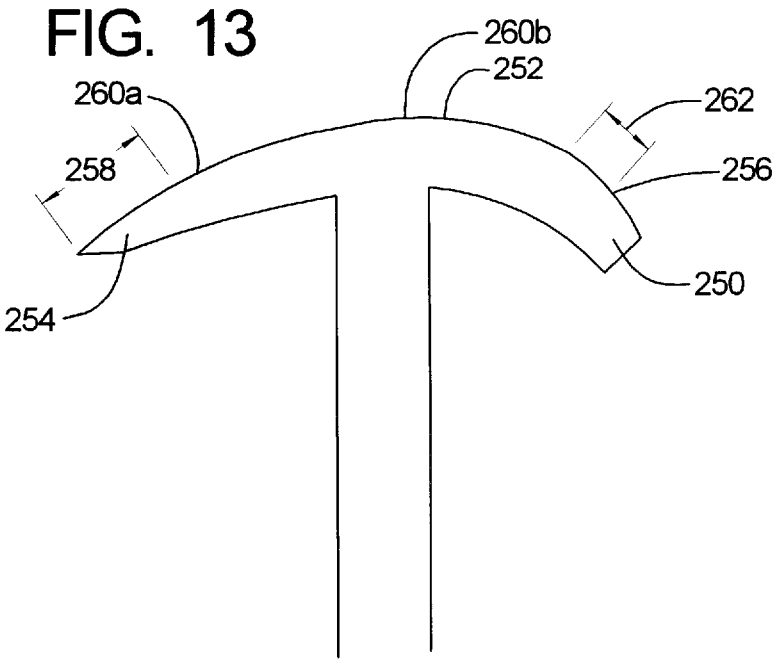
FIG. 13 is a side view of a fourth embodiment of the apparatus of the present invention.

A fourth embodiment of the present invention is shown in FIG. 13. Surface 260 represents a wood surface where 260*a* is the relative position of the tool 20 when the nail extraction process has just begun, and 260*a* is the relative position of the tool 20 when the nail extraction is almost complete.

The head portion 250 has a contact surface 252 which has a front portion 254 and a rear portion 256. It can be seen in FIG. 13 that the radius of curvature decreases when going from the front portion to the rear portion. The practical effect of this change in radius of curvature with respect to the transverse direction is that when a nail is first been extracted and the greatest force is required to withdraw the nail, the transverse contact distance 258 is greater which creates a greater surface area to contact the surface 260*a*. As mentioned above, the greater the contact surface is the less pressure upon the wood surface 260 and hence there is less likely to be an indentation on surface 260.

When the nail is substantially withdrawn from the wood, less force is required to finish the removal of the nail. Therefor the head portion 250 is in their relative position to surface 260*b* as shown in FIG. 13 and the transverse distance 262 is smaller which creates a smaller contact surface area with the surface 260*b*.

Figure 14:
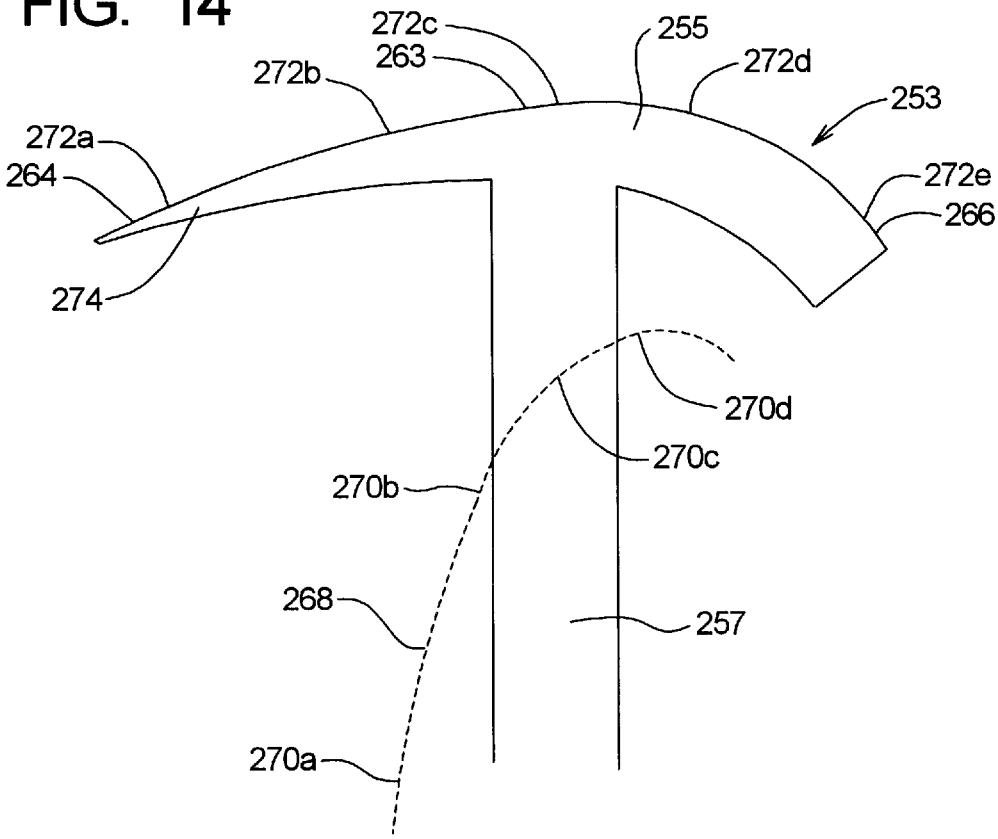
FIG. 14 is a fifth embodiment of the apparatus of the present invention showing a changing radius of curvature with respects to the location on the contact surface in the lengthwise direction.

FIG. 14 shows a fifth embodiment of the apparatus of the present invention where contact surfaces 263 has a front portion 264 and a rear portion 266 where the radius of curvature of surface 262 increases going from the front portion 264 to the rear portion 266.

The apparatus of the present invention is particularly advantageous for a carpenter who must carry the tool 20 on his tool belt. Most tool belts are configured with a loop 139 as seen in FIG. 6 and the tool 20 can easily be transported by being contained in loop 139 without fear that the tool 20 will accidentally fall out such as the prior art device in FIG. 1. Further, the extra rolling surface provides a greater range of motion of the fork portion so a smaller radius of curvature of the rolling surface can be used which creates less pressure on a wood surface.

As shown in FIG. 14, the tool 253 comprises a head portion 255 and the shaft portion 257. The dashed line 268 indicates the center of radius of curvature of the surface 262 with respect to the transverse distance of the tool 20. The portion 270*a* corresponds to the center of radius of the portion 272*a*. The distance of the center of radius in the front portion 274 can be between 1.5 inches to infinity. In some implementations a very flat front portion of the head is desirable to achieve maximum surface area contact with a wood surface when withdrawing a nail. The radius of curvature gradually decreases with respect to the rearward position location on head 255. As shown at portion 272*b* is rearward from portion 272*a* a distance of approximately 0.5 inches–1.5 inches. The radius of curvature at this portion is indicated at 270*b* of dashed line 268 and is a distance of the range 1 inch–7 inches. As shown at portion 272*c* which is rearwardly a distance of approximately 0.5 inches–1 inch is from portion 272*b* and has a center of radius at portion 270*c* that is a quantity of approximately 0.8 inches–5 inches. The portion 272*d* located approximately 0.5 inches–1 inch from portion 272*c* has a center of radius at portion 272*d* which is a value of approximately 0.5 inches–4 inches. Finally, the portion 272*e* located in the rearward portion of the head 255 has a center of radius of approximately 0.3 inches–3 inches. These ranges in a representative of a reduced radius of curvature with respect to the lengthwise direction. Important aspect of the embodiment shown in FIG. 14 is production of the radius of curvature of the surface decreases with respect to the lengthwise direction from the front portion to the rear portion.

While the invention is susceptible of various modifications and alternative forms, specific embodiments thereof have been shown by way of example in the drawings as described in detail. It should be understood, however, that it is not intended to limit the invention to the particular forms disclosed, but, on the contrary, the intention is to cover all modifications, equivalents and alternatives falling within the spirit and scope of the invention as expressed in the appended claims. It is desired that the embodiments described above may be considered in all respects as illustrative, not restrictive, reference being made to the appended claims to indicate the scope of the invention.

I claim:

1. A nail extraction tool which is adapted to be mounted to a loop when not in use and adapted to extract a nail having a head and a shaft wherein the nail extraction tool comprises:

a) an elongate shaft extending along a longitudinal axis and having an upper end portion and a lower end portion;

b) a head at the upper end portion of the shaft having a front end, rear end, and an intermediate location between the front end and rear end of the head, said head being connected to the upper end portion of the shaft at its intermediate location, said head having a lengthwise axis extending from the front end to the rear end of said head and being aligned generally transversely to said longitudinal axis, said head having an upperwardly facing front to rear first rolling contact surface and first and second side portions on opposite sides of said lengthwise axis, said head further comprising:

i) an extension portion located rearwardly of said intermediate location, and having a first contact surface that is adapted to engage a loop, said extension portion having a rearwardly facing impact surface, ii) a first nail extracting portion positioned in the said front portion and having a nail extracting surface portion comprising two fork portions adapted to engage the head of a nail, and having a second contact surface adapted to engage said loop;

c) said head being arranged so that the head can be manually grasped along the lengthwise axis of the head and along at least one of said side portions so that the head is adapted to be pulled or pushed in a direction generally perpendicular to the lengthwise axis;

d) a second nail extracting portion located at the lower end portion of the shaft, said second nail engaging portion comprising two downwardly extending fork members and a nail extracting surface area comprising surfaces of said fork members on the first side of the second nail extracting portion and facing in generally the same direction as the first side portion of the head;

e) said shaft having at its lower end a second rolling contact surface positioned so that a lateral alignment component of the second rolling contact surface is approximately parallel to the lengthwise axis of the head, and said rolling contact surface is located opposite of the nail extracting surface area of the second nail extracting position, whereby the first contact surface has a lengthwise component that extends forwardly from the upper end of the shaft and the second contact surface has a lengthwise component that extends rearwardly from the shaft, so that the shaft is adapted to extend through a loop and the head of the tool is adapted to be supported by the said loop, and the tool can be removed from the loop to extract a nail by a person grasping the lower end of the shaft to engage the head of the nail with the first nail extracting portion, or by grasping the head of the tool and extracting the nail by engaging the nail by the second nail extracting portion of the tool.

2. The nail extraction tool as recited in claim 1, wherein the first rolling contact surface extends in the lengthwise direction from the first nail extracting portion substantially beyond the intermediate location.

3. The nail extraction tool as recited in claim 2 wherein the first rolling contact surface extends in a lengthwise direction from the forward surface portion substantially beyond an adjacent rearward surface of the said shaft.

4. The nail extraction tool as recited in claim 1, wherein said first rolling contact surface has a radius of curvature at a location rearwardly of the intermediate location that is greater than the radius of curvature of the first rolling contact surface in location forward of the intermediate location.

5. The nail extraction tool as recited in claim 1, wherein the rear portion of the extension portion has a rearwardly facing impact surface positioned in a general plane having substantial alignment component parallel with the longitudinal axis of the shaft.

6. A nail extraction tool which is adapted to be mounted to a loop when not in use and adapted to extract a nail having a head and a shaft wherein the nail extraction tool comprises:

a) an elongate shaft extending along a longitudinal axis and having an upper end portion and a lower end portion;

b) a head at the upper end portion of the shaft having a front end, rear end, and an intermediate location between the front end and rear end of the head, said head being connected to the upper end portion of the shaft at its intermediate location, said head having a lengthwise axis extending from the front end to the rear end of said head and being aligned generally transversely to said longitudinal axis, said head having an upperwardly facing front to rear first rolling contact surface and first and second side portions on opposite sides of said lengthwise axis, said head further comprising:

i) an extension portion located rearwardly of said intermediate location, and having a first contact surface that is adapted to engage a loop, said extension portion having a rearwardly facing impact surface, ii) a first nail extracting portion positioned in said front portion and having a nail extracting surface portion comprising two fork portions adapted to engage the head of a nail, and having a second contact surface adapted to engage said loop;

c) said head being arranged so that the head can be manually grasped along the lengthwise axis of the head and along at least one of said side portions so that the head is adapted to be pulled or pushed in a direction generally perpendicular to the lengthwise axis;

d) a second nail extracting portion located at the lower end portion of the shaft, said second nail engaging portion comprising two downwardly extending fork members and a nail extracting surface area comprising surfaces of said fork members on the first side of the second nail extracting portion and facing in generally the same direction as the first side portion of the head:

e) said shaft having at its lower end a second rolling contact surface positioned so that a lateral alignment component of the second rolling contact surface is approximately parallel to the lengthwise axis of the head, and said rolling contact surface is located opposite of the nail extracting surface area of the second nail extracting portion, f) said shaft being constructed as a unitary structure that has a cross-sectional configuration along said longitudinal axis that is no greater than a distance between the first and second contact surface of the extension portion and the first nail extracting portion, said shaft having an outer surrounding surface that is substantially unobstructed from the head to the lower end portion of the shaft, whereby the first contact surface has a lengthwise component that extends forwardly from the upper end of the shaft and the second contact surface has a lengthwise component that extends rearwardly from the shaft, so that the lower end portion of the shaft is adapted to be inserted through a loop, have the shaft be moved through the loop, and have the head of the tool adapted to be supported by the said loop, and the tool can be removed from the loop to extract a nail by a person grasping the lower end of the shaft to engage the head of the nail with the first nail extracting portion, or by grasping the head of the tool and extracting the nail by engaging the nail by the second nail extracting portion of the tool.

* * * * *